United States Patent [19]

Slomovits

[11] 4,037,509

[45] July 26, 1977

[54] PRACTICE CYMBAL COVER

[76] Inventor: Ralph Slomovits, 19200 Roseland Ave., Euclid, Ohio 44117

[21] Appl. No.: 644,523

[22] Filed: Dec. 29, 1975

[51] Int. Cl.[2] ..... G10G 7/00

[52] U.S. Cl. ..... 84/422 R; 84/453

[58] Field of Search ..... 84/411 R, 453, 402, 84/465, 422 R, 411–421

[56] References Cited

U.S. PATENT DOCUMENTS

| | | | |
|---|---|---|---|
| 1,346,588 | 7/1920 | Bower | 84/465 |
| 2,565,225 | 8/1951 | Gladstone | 84/411 R |
| 2,893,283 | 7/1959 | Ipplito | 84/402 |
| 3,597,520 | 8/1971 | Andrews | 84/411 R |

*Primary Examiner*—Lawrence R. Franklin

[57] ABSTRACT

A practice cover for a cymbal for covering a major portion of the upper surface of the cymbal to provide a nonvibratory surface to be struck by a percussion stick when a player is practicing the cymbals. The practice cover muffles the sound of the cymbals to allow the percussion player to practice while maintaining the cymbals substantially noiseless. The practice cover includes a annular member formed from a resilient material having an outer diameter approximately equal to the diameter of the cymbal to be covered and a centrally located annular opening having a diameter substantially equal to the diameter of the bell of the cymbal to be covered. The annular member is adapted to overlie and be in substantially continuous contact with the upper surface of the cymbal to provide a nonvibratory surface to be struck by the percussion stick which simulates the action of the cymbal on the percussion stick while muffling the majority of the sound normally produced by the cymbal. Means are also provided for attaching the annular member to the cymbal stand supporting the cymbal to position the annular member in a position overlying the upper surface of the cymbal.

6 Claims, 3 Drawing Figures

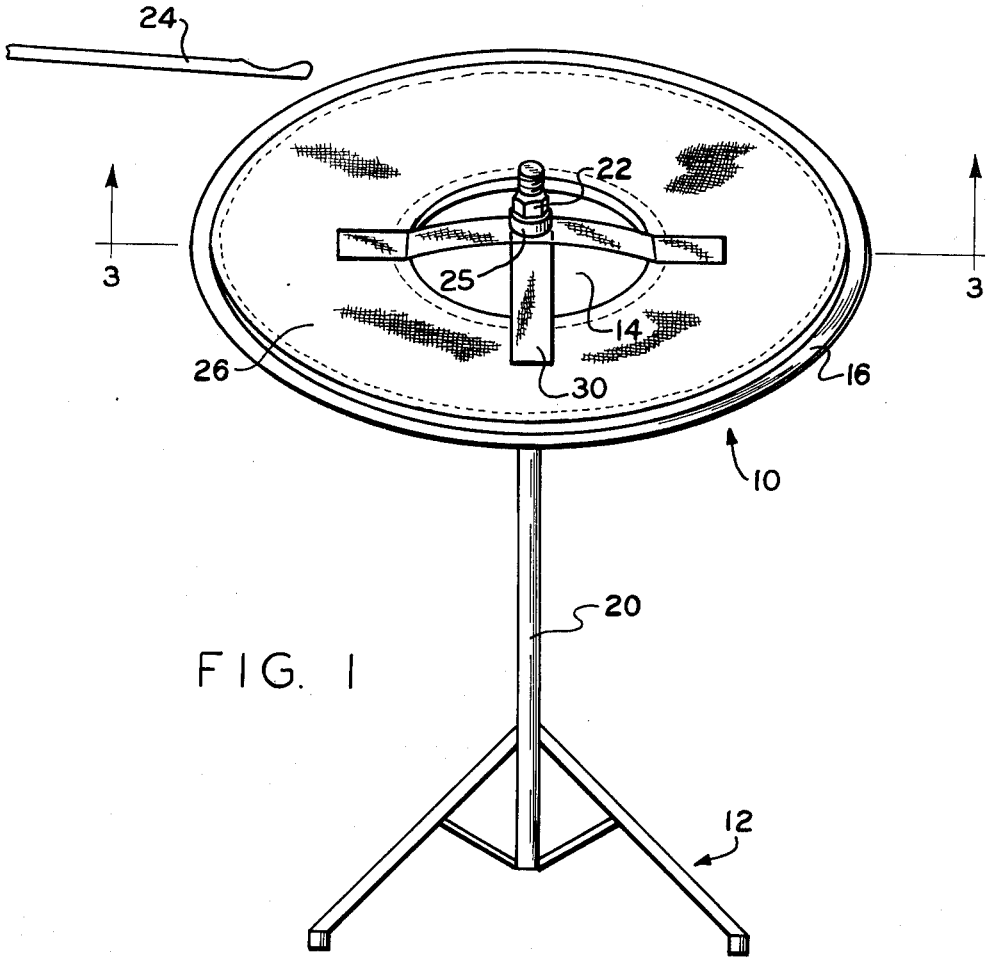
FIG. 1
FIG. 3
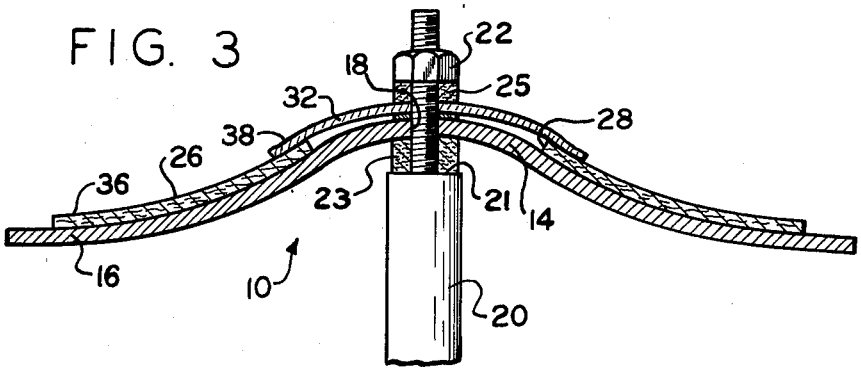

PRACTICE CYMBAL COVER

BACKGROUND OF THE INVENTION

The present invention relates to a practice cover for a cymbal and more particularly to a practice cover for a cymbal which overlies the upper surface of the cymbal to provide a surface to be struck by a percussion stick which muffles the majority of the noise normally associated with the cymbal.

Means for changing the sound of cymbals have been provided in the prior art. These means include structures which attach to the edge portion of the cymbal and which act to modify the sound of the cymbal. These structures did not substantially eliminate the sound of the cymbal. Rather the purpose of the structure was to change the sound of the cymbal.

Practice means for other percussion instruments are known in the prior art. However, these practice means are generally rigidly mounted and do not pivot as a cymbal normally does when it is struck by a percussion stick. Thus, these known practice means do not simulate the action of a cymbal on a percussion stick. Hence, these means do not lend themselves to the practice of cymbals in a noiseless fashion.

SUMMARY OF THE PRESENT INVENTION

The present invention relates to a practice cover for cymbals which includes an annular resilient member which is adapted to attach to and overlie the upper surface of the cymbal. The annular member is in substantially continuous contact with the upper surface of the cymbal to dampen any oscillations which might be set up in the cymbal and to provide a practice surface to be struck by a percussion stick which is nonvibratory and substantially noiseless. The practice cover is free to pivot or rock with the cymbal when it is struck by a percussion stick which enables the cover to simulate the action of the cymbal on the percussion stick.

In accordance with the present invention a practice cover for a cymbal for covering at least a major portion of the upper surface of the cymbal is provided. The practice cover includes a substantially circular member of resilient material having a diameter approximately equal to the diameter of the cymbal to be covered. The member of resilient material is adapted to overlie and be in substantially continous contact with the upper surface of the cymbal to provide a surface to be struck by a percussion player which simulates the action of the cymbal on the percussion player's stick while muffling at least 80% of the noise normally associated with the cymbal. Means are provided in the center of the member for affixing the member to the cymbal in a position overlying the upper surface at the cymbal.

The present invention provides a practice cover for a cymbal as set forth in the preceding paragraph wherein the resilient member has an annular configuration having a central opening having a diameter substantially equal to the diameter of the bell of the cymbal to be covered and wherein the resilient member is constructed of felt.

DESCRIPTION OF THE DRAWINGS

FIG. 1 is a perspective view of a cymbal disposed on a cymbal stand and having the practice cymbal cover of the present invention disposed thereon.

FIG. 3 is a cross sectional view taken approximately along the line 3—3 of FIG. 1 more fully illustrating the cymbal and the resilient practie cover.

DESCRIPTION OF THE PREFERRED IMBODIMENT

Figure 2:
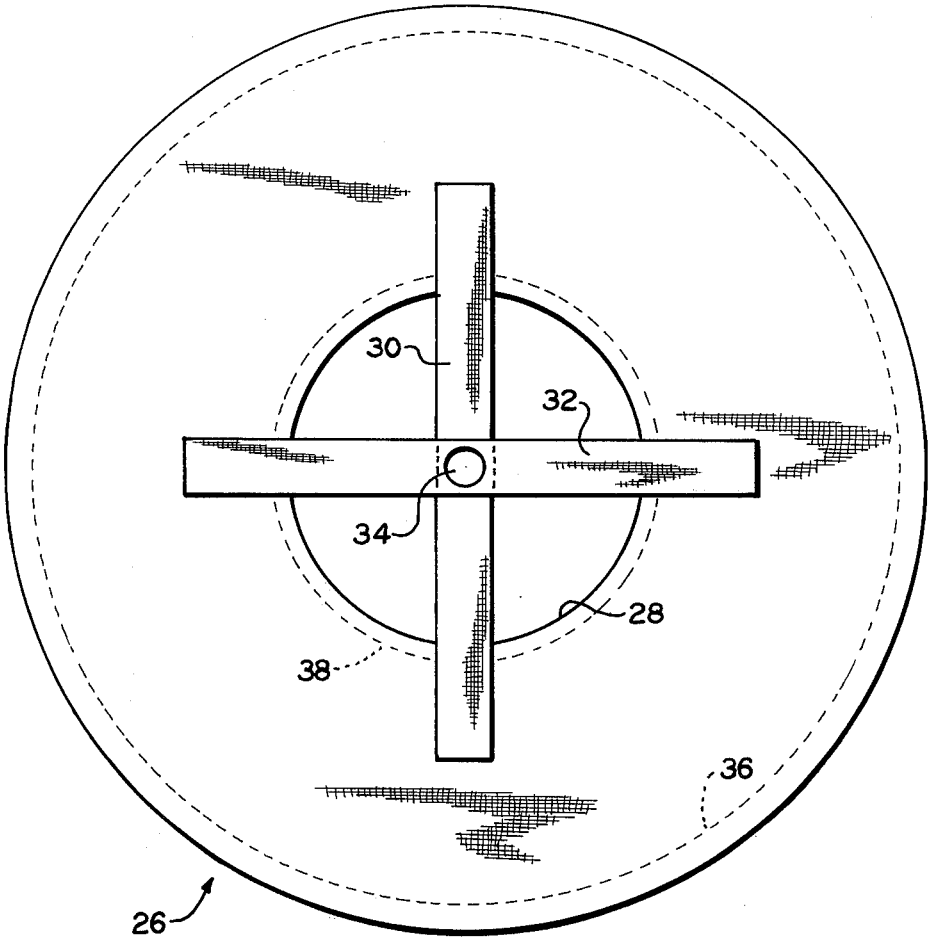
FIG. 2 is a plan view of the cymbal cover of the present invention.

Referring to FIG. 1, a cymbal 10 is illustrated supported on a cymbal stand 12. The cymbal 10 includes a curved bell portion 14 and a substantially flat portion 16. Centrally located in the bell portion 14 is an opening 18 which is adapted to receive the upright member 20 of the cymbal stand 12 therethrough. The upright member 20 includes an annular shoulder 21 which supports a felt washer 23 thereon. The cymbal 10 is supported on the felt washer 23 and another felt washer 25 is disposed above the cymbal 10 as illustrated in FIG. 3. A suitable nut 22 is provided for securing the cymbal 10 to the upright portion 20 of the stand 12 in a well-known manner. Striking of the cymbal 10 on the flat portion 16 thereof by a percussion stick 24 sets up a vibration in the cymbal 10 and establishes a musical tone in a well-known manner.

When a percussion player desires to practice the cymbal without generating a tone the practice cover 26 may be utilized. The practice cymbal cover 26 has a diameter which is approximately equal to the diameter of the cymbal 10 and includes an annular opening 28 disposed therein. The annular opening 28 has a diameter substantially equal to the diametr of the bell portion 14 of the cymbal on which the practice cover 26 is placed. The annular opening 28 allows the resilient member 26 to lie substantially flat on the flat portion 16 of the cymbal 10 as illustrated in FIG. 3. This enables the cymbal cover 26 to maintain substantially continuous contact with the upper surface of the cymbal 10. The continuous contact made with the upper surface at the cymbal 10 enables the resilient practice cymbal cover to dampen any vibrations set up in the cymbal 10. If noncontinuous contact was made between the cymbal cover 26 and the cymbal 10 then the cymbal 10 would be free to vibrate to some degree and the damping effect of the cymbal cover 26 would be reduced. While the cymbal cover has been illustrated as being approximately the same diameter as the cymbal 10 to be covered it should be appreciated that a variance of diameters between the practice cover 26 and the cymbal 10 can be tolerated. For example, there could be as much as an inch or an inch and one-half difference between the diameter of the cybal cover 26 and the cymbal 10.

A pair of perpendicularly disposed straps 30 and 32 bisect the annular opening 28 in the middle of the cymbal cover 26. The straps 30, 32 have a length greater than the diameter of the opening 28 to provide slack therein to allow the straps to conform to the bell 4 and thus maintain continous contact between the cover 26 and the upper surface of the cymbal 10. An opening 34 is disposed through the straps 30 and 32 to receive the upright 20 of the cymbal stand therethrough. The nut 22 may be affixed to the upright 20 after the upright 20 is disposed through the opening 34 in the straps 30, 32. In this manner the cymbal cover 26 can be attached concentrically to the cymbal stand so as to overlie the upper surface of the cymbal 10 as illustrated in FIG. 1 and 3.

The cymbal cover 26 can be made from any resilient material which effectively dampens the oscillation of the cymbal 10 while providing a feel to a percussion player which simulates the feel when a percussion stick is struck on the upper surface of the cymbal. It has been found that grade F-13 1/4¼ felt provides an ideal material for the resilient member 26. The felt dampens the oscillation of the cymbal 10 while providing a practice surface which simulates the feel of the cymbal. Suitable reinforcements are provided to reinforce the edges of the cymbal cover 26. To this end reinforcing material 36 and 38 is disposed around the exterior and interior edges of the member 26 to prevent deterioration of the felt.

Since the practie cymbal cover 26 is disposed on the upper surface of the cymbal 10, the cymbal cover 26 is free to rock with cymbal 10 when the cymbal is practiced. This of course increases the feel to the player. It has been found that use of a cymbal cover such as disclosed in the present invention eliminates at least 80% of the sound normally established when a cymbal is struck by a percussion stick. This allows a percussion player to practice the cymbal during times and at places where noise would normally be objected to by essentially muffling the sound of the cymbal to a very low level.

From the foregoing it should be apparent that a new and improved cover for a cymbal has been provided. The practice cover overlies the upper surface of the cymbal and provides a resilient surface which may be struck by a stick of a percussion player. The cover includes a substantially annular member formed from a resilient nonvibratory material which has an outer diameter substantially equal to the diameter of the cymbal to be covered and a centrally located annular opening having a diameter substantially equal to the diameter of the bell of the cymbal to be covered. The annular cymbal cover is adapted to be in substantially continuous contact with the upper surface of the cymbal to dampen any vibrations established in the cymbal and provide a resilient surface which may be struck by the stick of a percussion player during practice thereof.

What I claim is:

1. A practice cover for a cymbal for covering at least a major portion of the upper surface of the cymbal and providing a resilient surface which may be struck by a percussion stick, said practice cover comprising a substantially circular member of resilient material having a diameter approximately equal to the diameter of the cymbal to be covered, said resilient member including an annular opening disposed in the center thereof having a diameter substantially equal to the diameter of the bell portion of the cymbal to be covered, said annular opening allowing the substantially circular member of resilient material to overlie and be in substantially continuous contact with the upper surface of the cymbal to provide a surface to be struck by a percussion stick which simulates the action of the cymbal on the percussin stick while muffling at least eighty percent of the noise normally associated with the cymbal and means disposed in the center of said member for securing said resilient member in a position overlying the upper surface of the cymbal.

2. A practice cover for a cymbal as defined in claim 1 wherein said resilient material comprises felt.

3. A practice cover for a cymbal as defined in claim 1 wherein said resilient material comprises F-13 grade 1/4¼ felt.

4. A practice cover for a cymbal as defined in claim 3 further including a pair of perpendicularly disposed strap members each of which is secured to an inner edge of said resilient member which defines said annular opening and each of which bisects said annular opening, and wherein the means disposed in the center of said resilient member for securing said resilient member in a position overlying the upper surface of the cymbal includes a centrally located opening passing through each of said straps and which is adapted to receive a cymbal stand therethrough to thereby affix said resilient member relative to the upper surface of the cymbal.

5. A practice cover for a cymbal mounted on a cymbal stand for covering at least a major portion of the upper portion of the cymbal to provide a nonvibratory surface to be struck by a percussion stick in preference to the upper surface of the cymbal, said practice cover comprising an annular member formed from a resilient nonvibratory material, said annular member having an outer diameter substantially equal to the diameter of the cymbal to be covered and a centrally located annular opening having a diameter substantially equal to the diameter of the bell of the cymbal to be covered, said annular member being adapted to overlie and be in substantially continuous contact with the upper surface of the cymbal to provide a nonvibratory surface to be struck by a percussion stick and to dampen any vibration of said cymbal incurred upon the striking of the resilient material by the percussion stick, and means for attaching said annular member to a cymbal stand supporting the cymbal to thereby position the annular member in a position overlying the upper surface of the cymbal.

6. A practice cover for a cymbal as defined in claim 5 wherein said resilient material comprises F-13 grade ¼ inch felt.

* * * * *